US005284995A

United States Patent [19]

Melvin

[11] Patent Number: 5,284,995

[45] Date of Patent: Feb. 8, 1994

[54] METHOD TO EXTRACT AND RECOVER NITRAMINE OXIDIZERS FROM SOLID PROPELLANTS USING LIQUID AMMONIA

[75] Inventor: William S. Melvin, Huntsville, Ala.

[73] Assignee: The United States of America as represented by the Secretary of the Army, Washington, D.C.

[21] Appl. No.: 28,014

[22] Filed: Mar. 8, 1993

[51] Int. Cl.[5] ..... C06B 21/00

[52] U.S. Cl. ..... 588/203; 149/124; 588/202

[58] Field of Search ..... 149/124; 588/202, 203

[56] References Cited

U.S. PATENT DOCUMENTS

| | | | |
|---|---|---|---|
| H273 | 5/1987 | Melvin et al. | 149/109.6 |
| H305 | 7/1987 | Mitchell et al. | 556/143 |
| 4,854,982 | 8/1989 | Melvin et al. | 149/109.6 |
| 4,909,868 | 3/1990 | Melvin | 149/109.6 |

*Primary Examiner*—Edward A. Miller

*Attorney, Agent, or Firm*—Hugh P. Nicholson; Freddie M. Bush

[57] ABSTRACT

A method to extract and recover nitramine oxidizers from solid propellant using liquid ammonia employs four basic steps which are: (1) propellant removal by cutting or eroding into small pieces, followed by, (2) solution of the oxidizers by liquefied gas solvent ammonia, (3) separation of the insoluble binder, metal fuel, and additive components by filtration and recovery of the solid oxidizer by evaporation of the liquefied gas solvent ammonia, and (4) recompression to liquefy the gas solvent for reuse. The process is a closed system with no release of solvent to the environment. Cycle 1 reduces propellant size to ¼ inch or less to achieve efficient extraction in cycle 2 where insoluble ingredients (binder, metal fuel, additives) are separated from soluble ingredients. Insolubles are recovered and the solubles are recovered in cycle 3 by evaporation of the liquefied gas solvent ammonia. Cycle 4 is a solvent liquefaction and recycling of the liquid ammonia to the closed system. Washing the extracted ingredients in ethanol separates insolubles, nitramine and impurities from solubles, degraded nitroglycerine and other plasticizers. Standard acetone/water or cyclohexanone/water solution is employed for recrystallization of nitramine (HMX and RDX) which are recovered in high purity.

3 Claims, 10 Drawing Sheets

METHOD TO EXTRACT AND RECOVER NITRAMINE OXIDIZERS FROM SOLID PROPELLANTS USING LIQUID AMMONIA

DEDICATORY CLAUSE

The invention described herein may be manufactured, used, and licensed by or for the Government for governmental purposes without the payment to be of any royalties thereon.

BACKGROUND OF THE INVENTION

Solid propellant technology has evolved around the use of components readily available at the time of development and use. The surplus materials following World War II included gun powder, nitrocellulose, and other explosive ingredients. The availability of these materials motivated research for their use in solid propulsion technology. As these materials were used in solid propellants, the need for stabilizers was recognized. When stabilizers are used in solid propellants, a need is established for monitoring stabilizer chemical changes to ascertain their efficiency in stabilizing the propellant composition.

A patent of interest in the stabilizer technology field, which is assigned to the United States of America as represented by the Secretary of the Army, is U.S. Pat. No. 3,335,185. This patent was issued to Hiram W. H. Dykes on Aug. 8, 1967 and relates specifically to recovery of stabilizers, such as diphenylamine and resorcinol. In the method disclosed by this patent a small propellant sample (e.g., 100 mg.) is first dissolved in a suitable inert organic solvent having a low boiling point, acetone being preferred. The separation of the stabilizers is accomplished by specific materials known as developers in a thin-layer chromatography method. The developers are selected from the normal eluotropic series which is generally made up of a listing of solvents ranging from low polarity to high polarity. The developers are selected from the group consisting of n-hexane, carbon disulfide, carbon tetrachloride, trichloroethylene, toluene, benzene, methylene chloride, chloroform, ether, ethyl acetate, methyl acetate, aceton, n-propyl alcohol, ethyl alcohol, methyl alcohol and water.

Although the above method serves to separate and identify specific ingredients in small amounts, the separation and reclamation of massive amounts of propellant ingredients has not been of major concern since, prior to the use of very expensive specialty ingredients, the normal disposal of hazardous munitions and ingredients centered around open burning and open destruction (OB/OD). However, after environmental controls were implemented, and with expectation of more stringent controls in the future, the need for developing environmentally safe approaches for demilitarization and disposal of surplus and reject propellants, explosives, and energetic materials has become a major driving force.

The advancements of new technologies relating to propellant processing and reclamation of special ingredients from propellants highly loaded with particulate solids are disclosed in co-inventions as follows:

a. Statutory Invention Registration, Reg. Number H273, published on May 5, 1987, discloses "Processing of High Solid Propellant" by William S. Melvin and Porter H. Mitchell. This process relates to mixing of high solids loaded composite propellants at reduced viscosity by employing near critical liquid (NCL) carbon dioxide ($CO_2$) as a carrier fluid in a volume amount from about 10 to about 20 percent of the volume of the propellant ingredients. A typical composite propellant contains about 88 percent solids by weight, comprised of ammonium perchlorate, aluminum powder, ballistic modifiers, bonding agent, and about 12 percent liquid ingredients by weight, comprised of liquid polymers, plasticizers, and curatives.

b. Statutory Invention Registration, Reg. Number H305, published on Jul. 7, 1987, discloses "Demilitarization of High Burn Rate Propellant containing Ferrocene of its Derivatives" by William S. Melvin and Porter Mitchell. This invention accomplishes removal of about 99.8% to 100% of ferrocene or its derivatives (e.g., Catocene) from composite propellant which is undergoing demilitarization. After recovery of the high dollar value catalyst material, the propellant can be handled more safely during further processing using various ablation and/or mechanical methods to cut, remove, and comminute the propellant from a rocket motor case, for example, after which reclamation of other specific propellant ingredients can take place.

c. U.S. Pat. No. 4,854,982, issued on Aug. 8, 1989, discloses "Method to Demilitarize, Extract, and Recover Ammonium Perchlorate from Composite Propellants Using Liquid Ammonia" by William S. Melvin and James F. Graham. This method removes substantially 100% of the ammonium perchlorate (AP) from composite propellant in high purity. When large rocket booster units employing thousands of pounds of composite propellant are required to be demilitarized, an environmentally acceptable method is now available to recover a marketable product, ammonium perchlorate oxidizer, from the surplus propellant. This method recycles ammonia following extraction of the AP from the propellant. Recovering the AP from the liquid ammonia during liquid TM to-gas phase change may be accomplished using standard industrial chemical ingredient processing equipment such as crystallizers, rotary evaporators, and spray driers. Spray drying is a process whereby AP oxidizer is released in predetermined particle sizes based on liquid droplet sizes and rate of pressure change at a specified temperature. Following this phase change for recovering the AP, the gaseous ammonia is filtered, dried, and compressed to liquid ammonia for recycle/reuse within a closed system.

d. U.S. Pat. No. 4,909,868, issued on Mar. 20, 1990, discloses "Extraction and Recovery of Plasticizers From Solid Propellants and Munitions" by William S. Melvin. This method is directed to extracting and recovering plasticizers and their stabilizers from solid propellant, explosive, and pyrotechnic (PEP) source compositions in which the method employs either NCL or supercritical fluid (SCF) $CO_2$ as the solvent. The extraction and ingredient recovery method provides an environmentally acceptable alternative to traditional OB/OD of PEP source compositions. $CO_2$ solvent is nontoxic, nonflamable, noncorrosive, inexpensive, and does not generate any additional toxic or hazardous wastes. The $CO_2$ solvent is chemically inert when it is confined, pressurized, and/or heated in direct contact with PEP ingredients and compositions. $CO_2$ gas readily undergoes a NCL gas-to-liquid phase change when confined at a pressure of 831 psig or greater at ambient temperature. By further increasing the pressure and temperature of NCL $CO_2$ to 1058 psig and 31.3° C. or greater, respectively, SCF conditions of $CO_2$ are obtained. Either NCL or SCF $CO_2$ has the capability to be a selective solvent for soluble plasticizers (e.g., nitroglycerin (NG)) and their stabilizers (e.g., diphenylamines and nitroanilines) from nitrocellulose (NC) double base and crosslinked double base PEP materials. All undissolved (insoluble) propellant and munition ingredients are filtered and separated from the NCL or SCF $CO_2$ solvent prior to the pressure reduction/volume expansion recovery cycle. The recovery of soluble plasticizers and stabilizer from a NCL or SCF $CO_2$ solvent system is achieved by allowing the NCL or SCF solvent to undergo pressure reduction and phase change to the gaseous state. The gaseous $CO_2$ is then recycled for additional use in the method.

The employment of detonable, class 1.1 solid propellants by the military services has introduced additional complexities for achieving environmentally safe, rocket motor demilitarization and recovery of specific propellant ingredients for potential recycle/reuse in commercial and military products. Minimum signature, class 1.1 solid propellants typically contain the nitramine oxidizers cyclotetramethylenetetramitramine (HMX) and/or cyclotrimethylenetrinitramine (RDX), nitratoester plasticizers, chemical stabilizers, and a polymer binder. Smoky, class 1.1 propellants may additionally include AP oxidizer and aluminum (AL) metal fuel ingredients.

In July 1989, the U.S. Senate Armed Services Committee directed the establishment of a consolidated solid rocket motor demilitarization research and development program. The program goal is to dispose of large rocket motors in an economical, safe, environmentally acceptable, and reliable manner.

In response to national environmental policy goals established by the Resource Conservation and Reclamation Act (RCRA) and the Department of Defense mandate to minimize the generation of hazardous wastes, the U.S. Army Missile Command (MICOM) successfully explored applications of NCL and SCF technologies for solid rocket motor demilitarization and propellant ingredient recovery. Initial investigations examined the use of ammonia, carbon dioxide, and nitrous oxide as nontraditional extraction solvents for the recovery of ingredients from various PEP materials. These evaluations confirmed that specific liquefied, compressed gases were fully capable of dissolving a variety of PEP ingredients. By applying critical fluid (CF) technologies currently used by chemical processing and manufacturing industries, the recovery of valuable ingredients was demonstrated for PEP materials at the bench-scale. MICOM research resulted in an earlier patent issued to applicant which demonstrated that liquid ammonia at ambient temperature is a super-solvent for dissolving and separating AP, the principal oxidizer in class 1.3 composite propellants, from the insoluble AL/polymer binder components. Evaporation of the liquid ammonia solvent by pressure reduction provides a direct method for recovering the dissolved AP oxidizer and the AL/polymer binder propellant components. Because the critical fluid demilitarization process intentionally avoids the use of water as a propellant processing solvent, the generation of large amounts of contaminated waste effluents are avoided. This aspect provides the critical fluid demilitarization process with major environmental advantages over water-based processes that are less efficient and more energy consuming.

The above extensive review of background information teaches that significant progress has been made of achieving environmentally safe PEP demilitarization. The liquid ammonia rocket motor demilitarization process provides an environmentally safe method for demilitarizing class 1.3 AP composite propellant rocket motors with added benefits of ingredient recovery and hazardous waste minimization. Valuable AP oxidizer, AL polymer binder fuel ingredients, and motor hardware components are recovered for potential recycle/reuse. There remains a need for a similar process for the environmentally safe demilitarization of both minimum signature and smoky types of class 1.1 solid rocket motors and propellants.

The need for demilitarization and recovery of ingredients in 1.1 solid propellants is recognized; therefore, an object of the invention is to provide a method for ingredient recovery and hazardous waste minimization for hazard class 1.1 solid propellants.

A further object of this invention is to provide a method for dissolution, separation, recovery, and reclamation of valuable ingredients from minimum signature 1.1 propellants including smoky 1.1 solid rocket propellants which employ 1.3 solid propellant ingredients.

A specific object of this invention is to provide a method for dissolution, separation, recovery, and reclamation of HMX, RDX, AP, and AL/binder from 1.1 propellants and including 1.1 solid rocket propellants which employ 1.3 solid propellant ingredients.

SUMMARY OF THE INVENTION

An ammonia-based ingredient recovery method provides a viable alternative for class 1.1 solid rocket motor demilitarization with low environmental impacts, reusable ingredients, and technology that can be demonstrated using industrially available equipment.

The invention method comprises a first operation cycle for class 1.1 rocket motor demilitarization and propellant ingredient extraction, separation, and recovery which begins with the direct removal of solid propellant from a rocket motor source or direct use of bulk waste propellant source specimens. Both sources require particle size reduction to ¼ inch less to enhance ingredient extraction. Propellant removal from a solid rocket motor may be achieved by various methods such as hydraulic ablation using high pressure jets of liquid ammonia. The ammonia ablation method is similar to that currently used for ablating class 1.3 propellants using high pressure water. Experimental testing conducted for MICOM has successfully demonstrated the technical feasibility of ablating class 1.1 and 1.3 solid propellants using jets of liquid ammonia. Alternatively, mechanical cutting or machining of the solid propellant from the rocket motors can be used to produce propellant chips of sizes and configurations suitable for processing. Bulk waste propellant must be similarly reduced in size to facilitate efficient extraction of the soluble HMX and/or RDX ingredients from the class 1.1 propellants. A second operation cycle requires extracting soluble propellant ingredients from the ammonia/propellant slurry mixture generated during the aforementioned propellant removal and comminution cycle. The organic HMX and/or RDX nitramines, inorganic AP oxidizer, nitratoester plasticizers (and/or their chemical degradation products), and the chemical stabilizers, which may be in class 1.1 propellants, are solubilized and extracted into the liquid ammonia phase as a supernatant fluid. The sediment portion could consist of insoluble polymer binder, AL fuel ingredients, and ballistic additives. The insoluble sediment portion remains as a slurry mixture until it is physically separated from the extractor/separator system (e.g., by filtration, centrifugation, or similar industrial process), and the ammonia is removed by evaporation. For smoky class 1.1 propellants, the recovered AL/binder by-product may be used for recycle purposes, such as in the manufacture of cement products.

A third operation cycle requires the evaporation of liquid ammonia solvent to recover all soluble propellant ingredients which could include a mixture of HMX, RDX, AP, energetic and degraded plasticizer, and propellant stabilizer ingredients.

(Note: Special monitoring is required during the dissolution and extraction of the soluble ingredients of the second operation cycle, as ammonia immediately begins to chemically degrade the reactive NG plasticizers and NC polymer binder ingredients.) Temperature rises from any exothermic degradation reactions will increase the system operating pressure above the normal vapor pressure of liquid ammonia. Venting of excess pressure will automatically result in adiabatic cooling of the liquid ammonia solvent as the ammonia gas is expanded. This cooling effect will maintain a constant system operating temperature. The vented ammonia gas is returned to the system for reuse. Alternatively, the system may be designed to incorporate industrial heat exchange coils to compensate for the mildly exothermic, temperature increases resulting from NG and NC chemical degradation with liquid ammonia.

A fourth operation cycle involves recompression of the expanded ammonia gas streams for regeneration to its original liquid condition. The ammonia gas is filtered, dried, and compressed for reuse within the closed demilitarization and ingredient recovery system. In the closed system, no ammonia is released to the environment.

The recovered, soluble propellant ingredients in the third operation cycle can be washed with an alcohol to separate the soluble products (e.g., AP, degraded NG, related energetic plasticizers, and the stabilizers) from the insoluble HMX/RDX ingredients. The alcohol washed nitramines may be purified by crystallization from acetone/water or cyclohexanone/water.

DESCRIPTION OF THE PREFERRED EMBODIMENT

The method to extract and recover nitramine oxidizers is comprised of a class 1.1 solid propellant demilitarization cycle 1 to provide a source of propellant particles of about ¼ inch or smaller to enable efficient extraction with liquid ammonia solvent at ambient temperature and at a pressure of about 114 psig to maintain ammonia in a liquid state. A further separation and recovery of nitramine oxidizers by treating all liquid ammonia soluble class 1.1 solid propellant ingredients recovered during operation cycle 3 previously described hereinabove and further described below.

Figure 1:
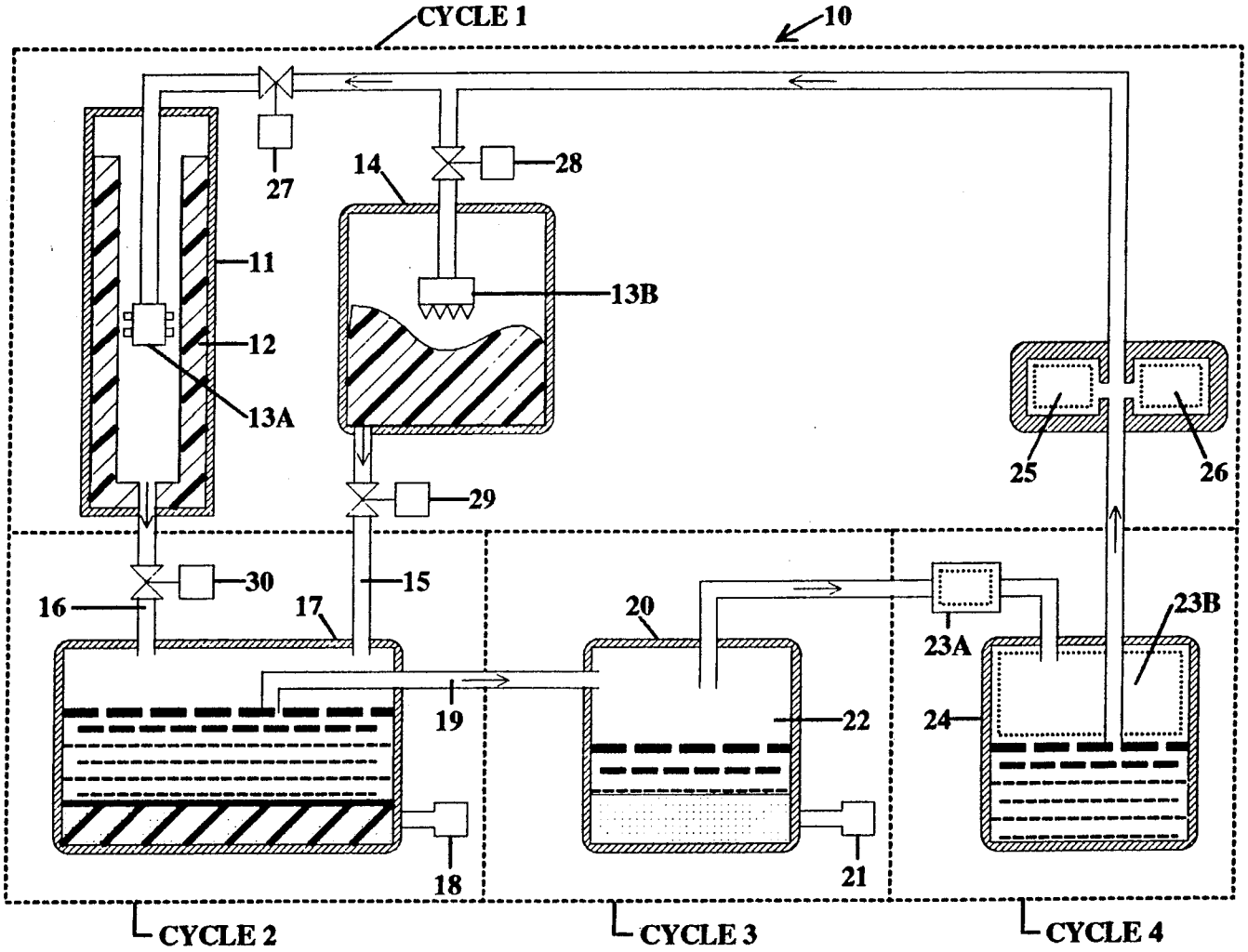
FIG. 1 is a process schematic for rocket motor demilitarization and propellant slurry processing.

In further reference to the Drawing, FIG. 1 depicts operation cycles 1–4 of a class 1.1 solid propellant demilitarization system 10. Operation cycle 1 comprises a pressure vessel in the form of a rocket motor 11 containing propellant 12 which may be removed from the motor by various methods. These removal methods may include mechanical cutting and comminution of the solid propellant and/or liquid jet ablation of the solid propellant using high pressure nozzles 13A or modified mechanical cutting and comminution fixture 13B which are in communication with high pressure pump 26. Alternatively, a pressure vessel 14 can be employed in place of rocket motor 11 for the purpose of recovering ingredients from waste propellant sources. The function of pressure vessel 14 is to macerate waste bulk propellant specimens for introduction into the extraction/separator system 17, as illustrated in FIG. 1. Valves 27, 28, 29, and 30 are employed to align pressure vessels in which the propellant is ablated or to isolate pressure vessel 11 or 14 in which propellant is not being ablated. Propellant slurry 15 or 16 from either the pressure vessel 11 or from pressure vessel 14 is transferred to the extractor/separator system 17 from which insoluble ingredients 18 (e.g., polymer binder, ballistic additive metal fuel) are separated from the soluble ingredients 19 (e.g., dissolved nitramine oxidizers, plasticizers, and stabilizers) during operation cycle 2. Operation cycle 3 provides for evaporation of the liquid ammonia solvent to recover ammonia soluble ingredients as a mixture which includes the nitramine oxidizers and plasticizers 21.

The ammonia vapor 22 is transferred to the filter/dryer 23A and compressor 23B which liquefies the ammonia vapor as part of the liquefaction and recycling system 24 in operation cycle 4. The low pressure pump 25 may be utilized at any time for supplying liquid ammonia to any or all system components, as required, during the demilitarization and ingredient recovery process. Further detailed descriptions including processing of nitramine oxidizer and other solids recovered in operation cycle 3 are provided below.

Figure 2:
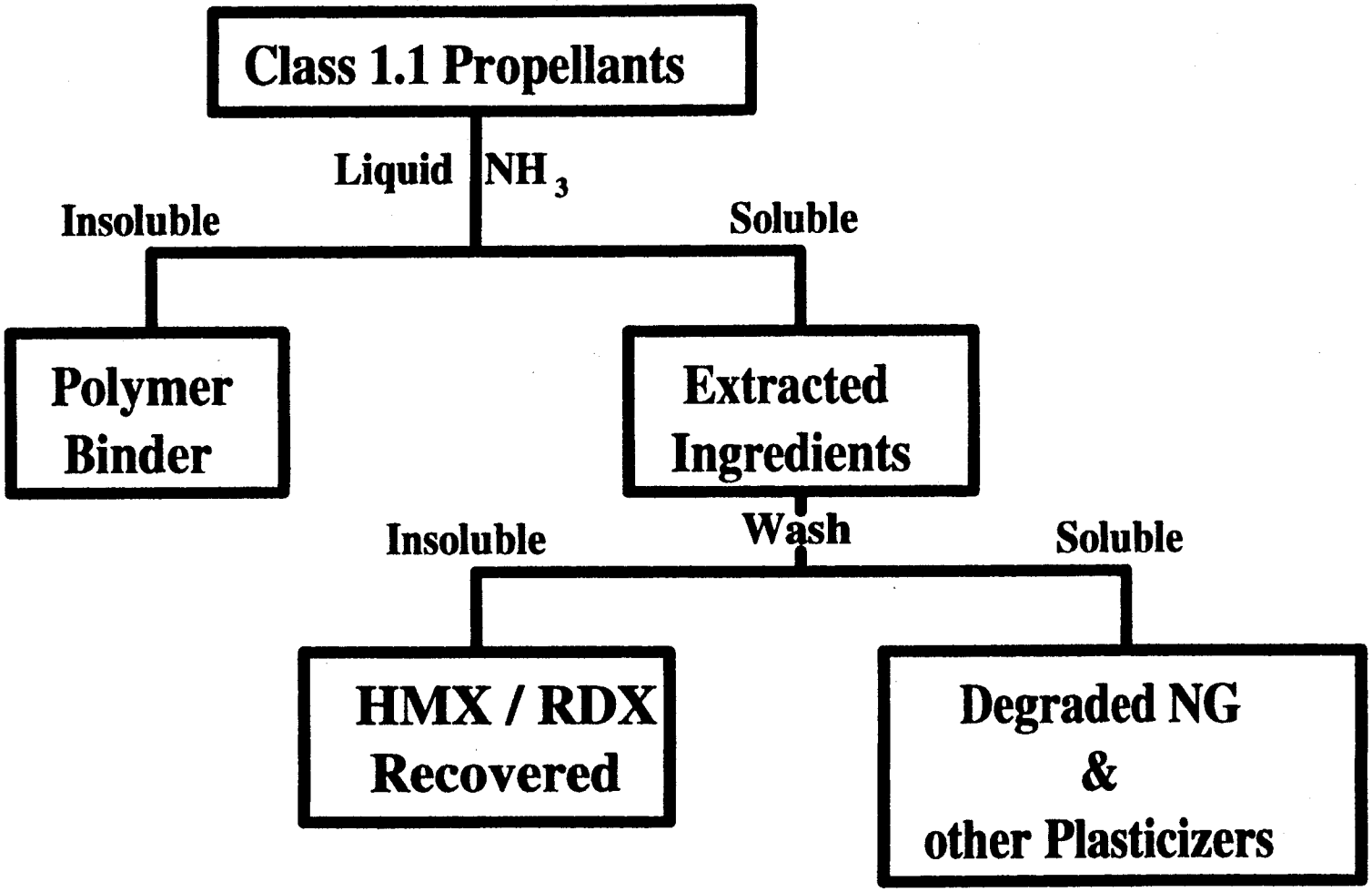
FIG. 2 is a flow diagram for demilitarizing minimum signature class 1.1 propellants using the CF ingredient separation and recovery process. (These propellants do not contain AP oxidizer or AL fuel additives.)
Figure 3:
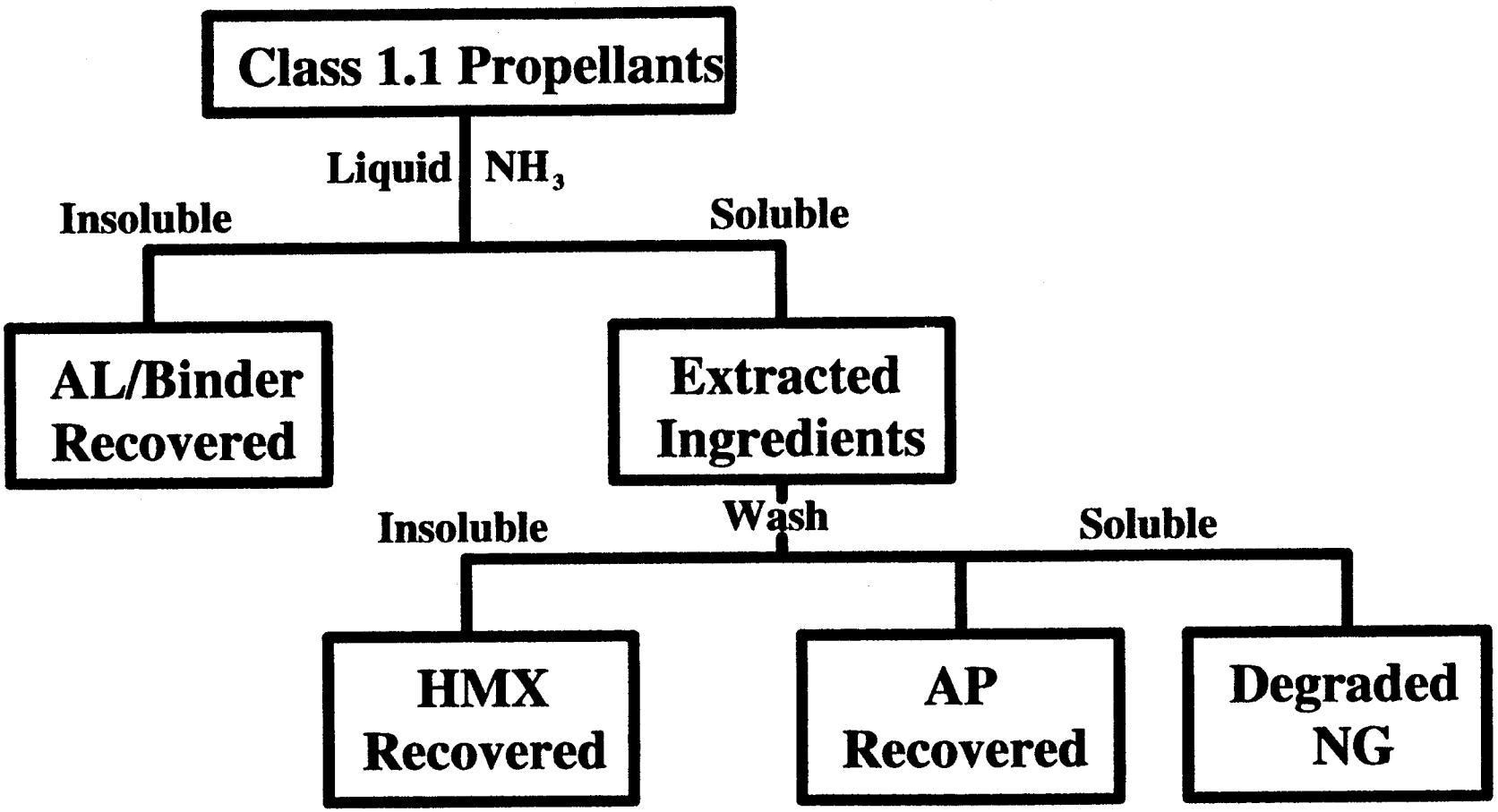
FIG. 3 is a flow diagram for demilitarizing smoky class 1.1 propellants using the CF ingredient separation and recovery process.
Figure 4B:
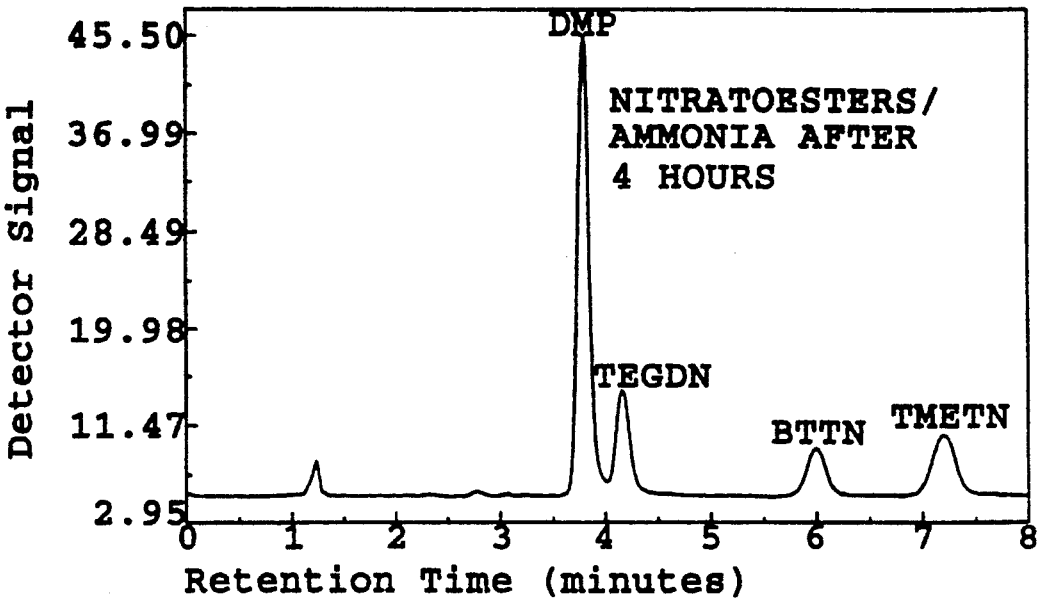
FIGS. 4*a*, 4*b*, 4*c*, and 4*d* are liquid chromatography (LC) curves depicting the chemical behavior of various lower energy, nitratoesters that were dissolved in liquid ammonia for periods of approximately 30 minutes, 4 hours, 8 hours, and 48 hours, respectively. These nitratoesters and the LC internal standard shown in FIGS. 4*a–d* are triethyleneglycol dinitrate (TEGDN), 1,4-butanediol trinitrate (BTTN), trimethylolethane trinitrate (TMETN), and dimethylpthalate (DMP).
Figure 4A:
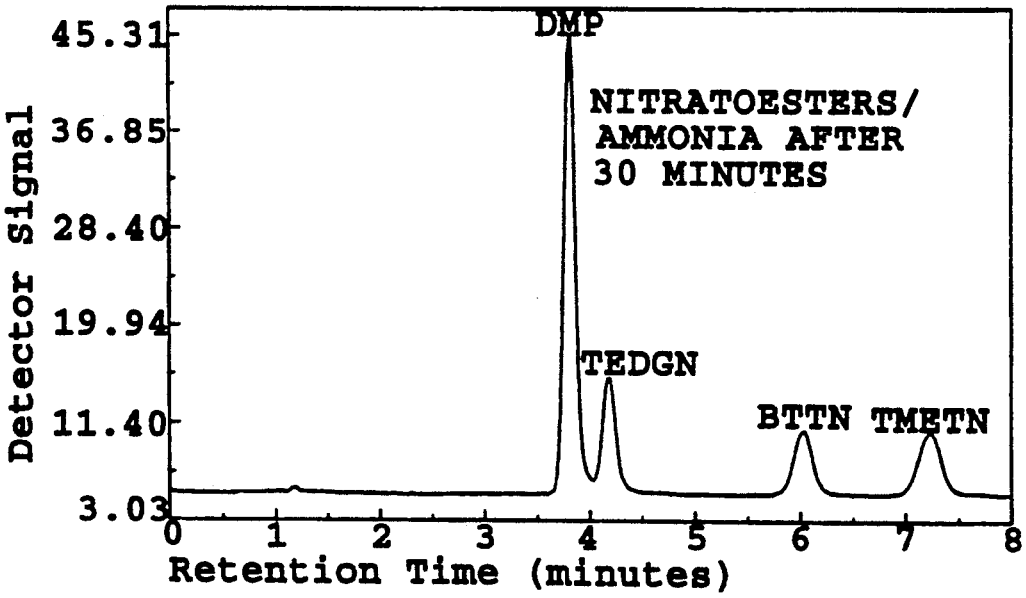
Figure 4D:
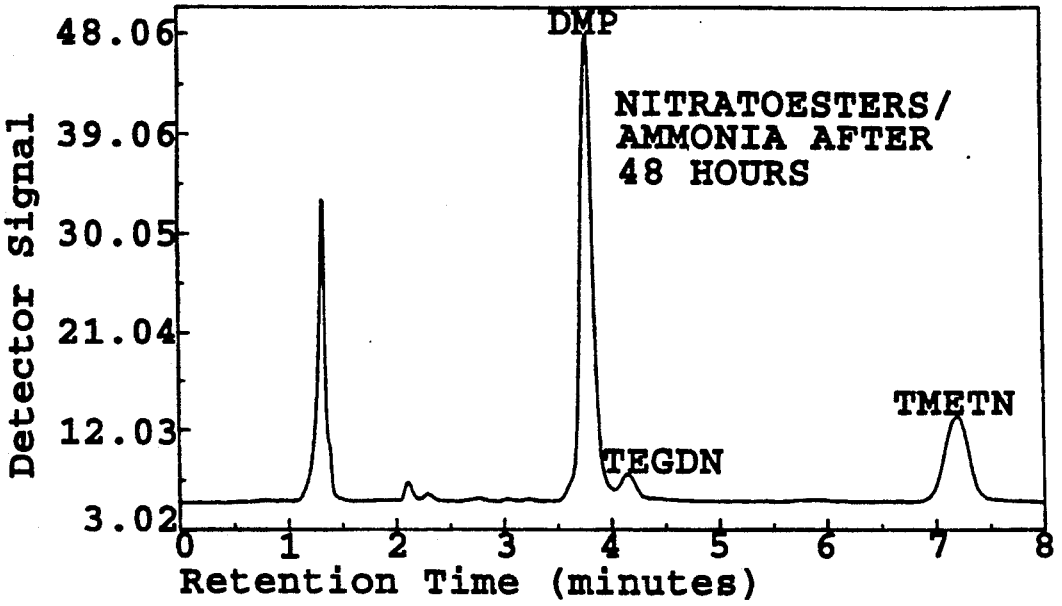
Figure 4C:
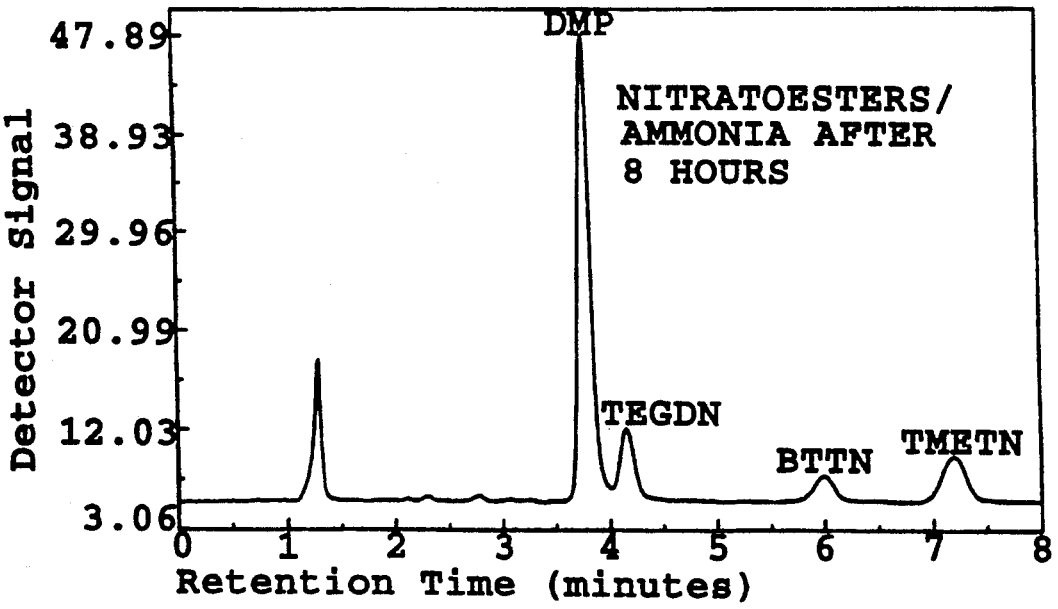
Figure 5B:
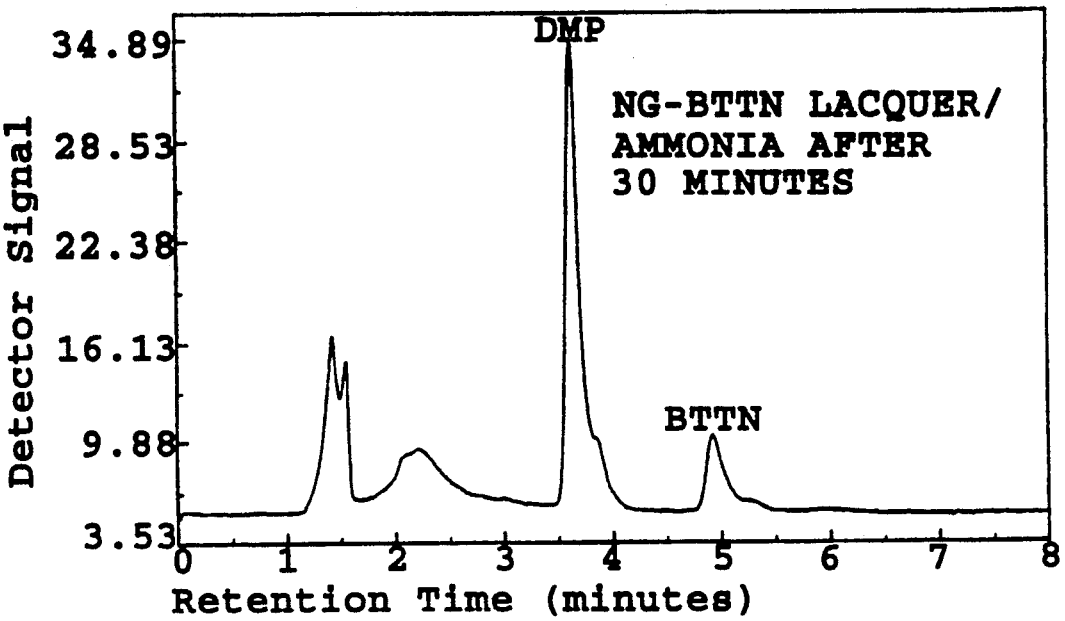
FIGS. 5*b*, 5*c*, and 5*d* are LC chromatograms of the same NG-BTTN lacquer following dissolution in liquid ammonia for periods of approximately 30 minutes, 8 hours, and 24 hours, respectively.
Figure 5A:
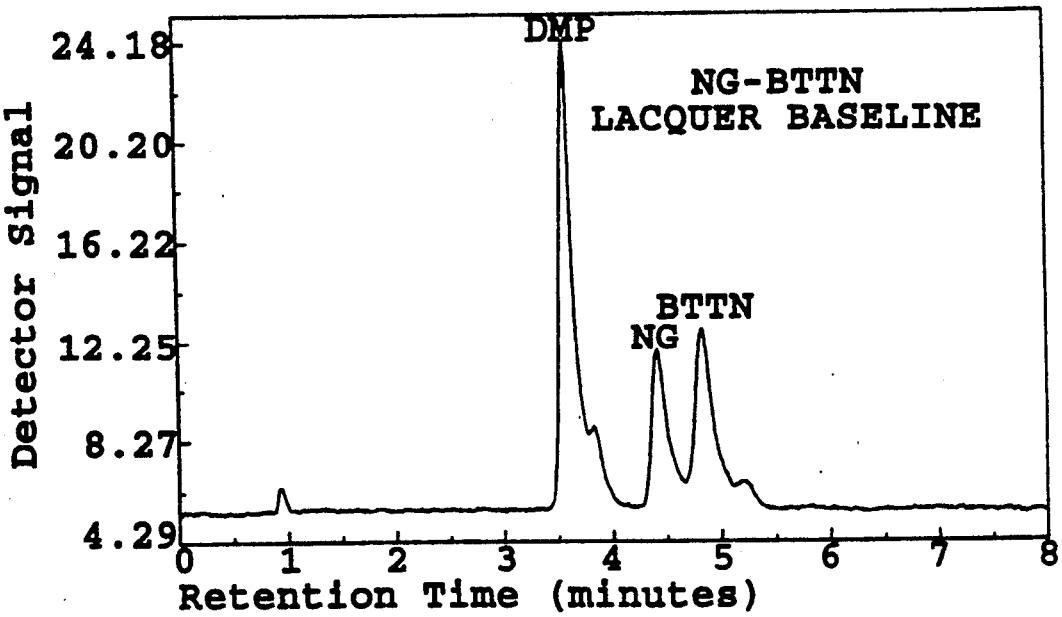
FIGS. 5*a* is a reference LC chromatogram of a NG-BTTN premix lacquer prior to ammonia addition.
Figure 5D:
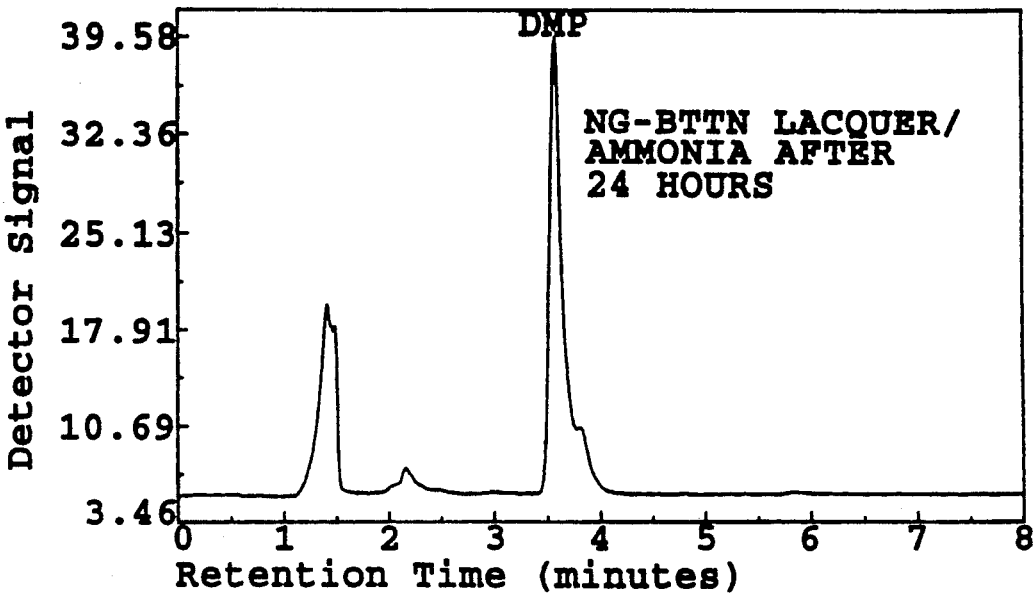
Figure 5C:
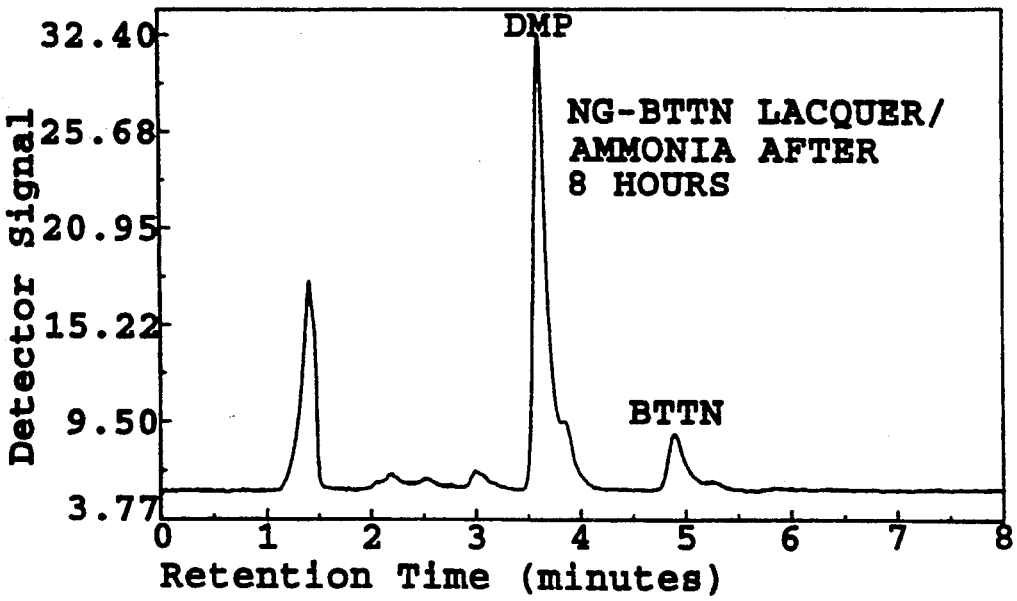

The liquid ammonia extraction, ingredient recovery, and propellant demilitarization method provides a direct method to separate soluble and insoluble solid propellant components common to most class 1.1 crosslinked double base (XLDB), composite modified XLDB, and composite modified double base (CMDB) propellants. Typically, the insoluble propellant components consist of the propellant binder and ballistic components. Depending on propellant type and specific formulation, typical insoluble propellant components consist of various crosslinked polymers, carbon, metal-containing combustion additives, and aluminum metal fuel. Ammonia soluble propellant components include HMX, RDX, AP, nitratoester plasticizers, and stabilizers. In the case of the NG nitratoester plasticizer, a controlled chemical degradation reaction occurs in the presence of liquid ammonia. All of these soluble ingredients may be directly recovered from the solution by evaporation of the liquid ammonia solvent. Final separation and recovery of the target materials in pure form can be accomplished using a wide variety of chemical wash, extraction, and crystallization separation methods. Two representative ingredient separation and purification schemes are shown in FIGS. 2 and 3. Using, for example, the chemical separation scheme depicted in FIG. 2 for class 1.1 propellants that do not contain any AP or AL ingredients, bench scale experiments have demonstrated quantitative recovery of the target nitramines following removal of the liquid plasticizers and stabilizers by washing with ethanol. The nitramines can be recrystallized and recovered in pure form from acetone/water solution. Chemical and physical analyses of the HMX and RDX products recovered using the liquid ammonia method confirm that the recovered nitramines are virtually identical to as-received virgin materials. In smoky class 1.1 solid propellants, the AP can be separated and recovered from the crude recovery mixtures of AP, nitramines, plasticizers, and stabilizers after evaporation of the liquid ammonia extraction solvent. Several possible standard chemical laboratory approaches exist for final separation and recovery of the solid AP oxidizer from these mixtures. The most direct method is to begin with the separation of the nitramine ingredient(s) from the other components. Methanol, for example, is an excellent separation solvent and has been used successfully to dissolve the AP, plasticizers, and stabilizers. Ethanol and isopropanol can be used for washing and as a separation solvent. The HMX and RDX nitramines are insoluble in methanol. Thereby, these nitramines are readily separated from the AP, plasticizers, and stabilizers using methanol. The nitramines are recovered in a form suitable for final purification using standard crystallization methods. The AP oxidizer can be separated from the resulting plasticizer and stabilizer mixture by using other standard chemical separation procedures, such as soxhlet extraction or anti-solvent crystallization technique employing an aliphatic, cyclic or aromatic hydrocarbon. Butanol solvent was shown to work well for the soxhlet extraction and recovery of AP from the plasticizer and stabilizer mixture. Hexane was used successfully as an anti-solvent to crystallize and recover AP from the methanol solution containing the dissolved stabilizer and degraded plasticizer mixture.

CLASS 1.1 PROPELLANT DEMILITARIZATION CYCLE

The class 1.1 rocket motor demilitarization process involves four cycles, as depicted in FIG. 1. The first operation cycle in the demilitarization process requires the removal of solid propellant 12 from a rocket motor 11. Propellant removal can be accomplished by any of several possible methods which may include liquid ammonia hydraulic ablation and/or mechanical cutting to comminute the propellant using a robotically controlled, propellant removal system 13. The propellant removal system 13 depicted in FIG. 1 may be modified or changed out to allow high pressure ablation, low pressure ablation or washing, and/or mechanical cutting. Propellant specimen size reductions to ¼ inch or less are required to enhance efficient ingredient extraction.

During a hydraulic ablation process, a liquid ammonia propellant slurry mixture is formed. Slurry mixtures are fed into an extractor/separator system 17. Liquid ammonia jet ablation of rocket motor propellants may require the use of high pressure pump 26 to operate at pressures in the approximate regime of 5–40 Kpsi. Valves 27 and 30 are opened and valves 28 and 29 are closed when propellant is ablated from rocket motor 11. Valves 27 and 30 are closed and valves 28 and 29 are open when propellant is ablated from waste propellant vessel 14.

Dry propellant removal from rocket motor 11 is achieved by mechanical machining and cutting using a modified fixture 13B for propellant removal and for producing propellant chips of a size suitable for extraction by liquid ammonia. In this event, chips may be batch processed following transfer directly into the extractor/separator system 17. Alternatively, the chips may be added to waste propellant vessel 14 for possible high pressure ammonia jet pre-treatment and further comminution prior to introduction into the extractor/separator system 17.

Propellant removal from the rocket motor may also involve the combined use of both mechanical cutting in communication with low pressure ammonia jet removal of the propellant chips. Low pressure ablation may enhance transfer of the chips into the extractor/separator vessel 17 and minimize possible heating of the mechanical cutting blades and propellant chip surfaces. In this event, low pressure pump 25 would be used in place of high pressure pump 26 and propellant removal system 13 would be modified to accommodate this dual feature.

The second operation cycle requires the use of liquid ammonia to solubilize and extract the energetic nitramine, ingredients. The extractor/separator system 17 is used to separate the soluble propellant ingredients from the insoluble propellant fuel ingredients. Ingredient separation is accomplished by filtration or similar mechanical process. Residence time for the soluble ingredients in the slurry mixture is dependent on propellant configuration, morphology, ingredient extraction efficiency, and related factors.

These two initial operational cycles in the process are similar to those used for class 1.3 AP propellants. The only significant deviation is that nitratoester plasticizers are soluble in liquid ammonia, whereas the less polar organic plasticizers in class 1.1 AP propellants are not soluble. As a result, nitratoester plasticizers, and/or their chemical degradation products, and chemical stabilizers in the class 1.1 propellants are carried into the liquid ammonia phase to the evaporator and ingredient recovery system 20 for oxidizer separation and recovery. (See FIGS. 1 and 2).

The third operation cycle requires the evaporation of the liquid ammonia solvent in the evaporator and ingredient recovery system 20. (See FIG. 1]. Solvent evaporation produces a mixture of the extractable, solid and liquid propellant ingredients. Depending on the composition of the class 1.1 propellant, this mixture could consist of solid nitramines (HMX and/or RDX), liquid energetic plasticizers (NG, BTTN, TMETN, etc.) and their possible degradation products, as applicable, solid chemical stabilizers, and solid AP oxidizer. Final separation of these ingredients from each other can be accomplished using a variety of chemical wash and separation techniques which will be described in a later section of this disclosure.

The fourth operation cycle involves filtering, drying, and compression of the expanded ammonia solvent vapor 22 for reuse within the closed system. (See FIG. 1).

Conventional propellant ingredients which are soluble and can be separated in accordance with this invention include oxidizers such as AP, ammonium nitrate (AN), potassium perchlorate ($KClO_4$), HMX, and RDX. Insoluble metals which are separated from soluble ingredients include those that are not reactive toward liquid ammonia at low temperatures, such as aluminum.

Since demilitarization can include both degrading of high energy ingredients to render them safe for disposal and the recovery of valuable, recyclable ingredients for industry, the following descriptions are directed specifically to class 1.1 XLDB and CMDB propellants as processed by applicant's method.

The demilitarization and recovery of valuable ingredients from class 1.1 propellants involve essentially the same liquid ammonia extraction process used for class 1.3 AP composite propellants. These class 1.1 propellants principally consist of nitramines, nitratoesters and, in many cases, include the class 1.3 ingredients AP and AL. From a chemical engineering 10 perspective, the process for demilitarizing class 1.3 AP composite propellants is considered a subset of a slightly more complex process to demilitarize and recover ingredients from class 1.1 propellants. An important safety issue of using liquid ammonia for demilitarizing class 1.1 propellants is controlling the moderately exothermic, chemical degradation of high energy nitratoesters (i.e., NG and NC) during the extraction and recovery process. Liquid ammonia chemical j interactions with all representative types of class 1.1 propellants and their ingredients have been investigated by intense studies at the MICOM. These studies have demonstrated that liquid ammonia can be used to extract, recover, and/or chemically degrade high energy ingredients from class 1.1 propellants. Experimental evaluations have been safely conducted using up to one pound quantities of class 1.1 propellants in high pressure, glass reaction vessels. The key to the safe demilitarization of these propellants is in controlling heat transfer in liquid ammonia solutions and maintaining operating conditions within specified ranges.

More than one hundred experiments at the bench scale have been conducted at MICOM under a wide variety of conditions and with virtually all types of class 1.1 propellants. Although the mechanism of decomposition of NG with liquid ammonia is not fully resolved, experimental temperature, pressure, and visual recordings have demonstrated that NG is highly soluble in liquid ammonia and that liquid ammonia serves as an effective heat transfer media. Continuous monitoring of finely divided class 1.1 propellants, energetic premix lacquers, and neat ingredients stirred in the presence of a least ten fold excess liquid ammonia demonstrated only moderate reaction temperature and pressure increases over the entire ingredient extraction and recovery process. With initial experimental operating conditions at ambient temperature and approximately 114 psig, observed temperature increases of 5° to 10° C. typically result from NG reaction with the liquid ammonia solvent. Non-NG containing nitratoester plasticized class 1.1 propellant systems (e.g., those containing only BTTN and TMETN plasticizers) produced minimal increases in solvent temperature of approximately 1 degree per hour. Similarly, minimal increases in solvent vapor pressure as a function of time were observed. System pressure gauges provided an excellent method for monitoring the efficiency of heat transfer and determining reaction parameters. For example, a temperature rise of 10° C. would be expected to automatically increase the vapor pressure of the liquid ammonia solvent by approximately 30 psig. In a similar manner, venting of any excess system pressure due to heating of ammonia solvent from the moderately exothermic decomposition of NG automatically results in cooling of the ammonia solvent. Although low pressure relief mechanisms were integrated in the various MICOM test apparatuses, in no instance did any of the relief valves self-actuate.

Bench scale prototype results provided every indication that the liquid ammonia process could be pilot plant designed and constructed to maintain optimum processing conditions for class 1.1 propellant demilitarization. Typical laboratory batch processing to extract and separate soluble and insoluble class 1.1 propellant components is routinely completed within 15 minutes. Recovery of soluble ingredients is by evaporation of the liquid ammonia solvent at reduced pressures. Adiabatic cooling during solvent evaporation effectively- inhibits any additional decomposition reaction. Soluble ingredients are automatically recovered from solution as the ammonia is evaporated. It is at this point where the class 1.1 process differs from the class 1.3 process. With class 1.1 propellants, this initial recovery step results in a composite mixture of the soluble components consisting of the plasticizer(s), nitramine(s), stabilizers and, depending on formulation, AP oxidizer. Final reclamation of individual ingredients requires chemical separation of these components. Chemical separation practices, such as alcohol washing, filtration, and acetone or cyclohexanone recrystallization of the recovered HMX OR RDX nitramines, respectively, work well for final ingredient separation and purification. With aluminized propellants, both the metal and polymer are separated from the ammonia solution as insoluble components. Flow diagrams for ingredient recoveries from minimum signature and smoky class 1.1 propellants are shown in FIGS. 2 and 3. This experimental method has proved highly successful for recovering all the desired Class 1.1 propellant ingredients in forms amenable for potential reclamation.

The chemical behavior of class 1.1 nitratoester plasticizers and nitramine oxidizers with liquid ammonia has been an area of active investigation at MICOM. Liquid chromatography (LC) and differential scanning calorimeter (DSC) analyses confirm efficient recovery of HMX, RDX, AP, and AL ingredients from class 1.1 propellants by using liquid ammonia. Test findings demonstrate that NG and NC are rapidly attacked by liquid ammonia and, given sufficient exposure time, will continue to undergo slow, secondary reactions. These reactions will eventually lead to the complete degradation and desensitization of NG plasticizer and NC polymer binder.

Although the thermodynamics for nitratoester degradation with ammonia are favorable, the kinetic reactions in liquid solution are relatively slow. These apparently slow, and still not completely understood, kinetic reactions provide a unique opportunity to efficiently demilitarize class 1.1 propellants and recover their valuable ingredients. The chemical kinetics of NC degradation appear to be similar to NG behavior. Lower energy nitratoester plasticizers (BTTN, TMETN and TEGDN]are much less reactive toward liquid ammonia. The observed reaction order is BTTN>TEGDN>TMETN with primary degradation rates of 1 day, 3 days, and virtually unaffected after several days, respectively. Representative LC chromatograms of these nitratoester plasticizers are shown in FIGS. 4a–4d. Secondary degradation reactions to form inert products are anticipated to occur over much longer periods.

Figure 6C:
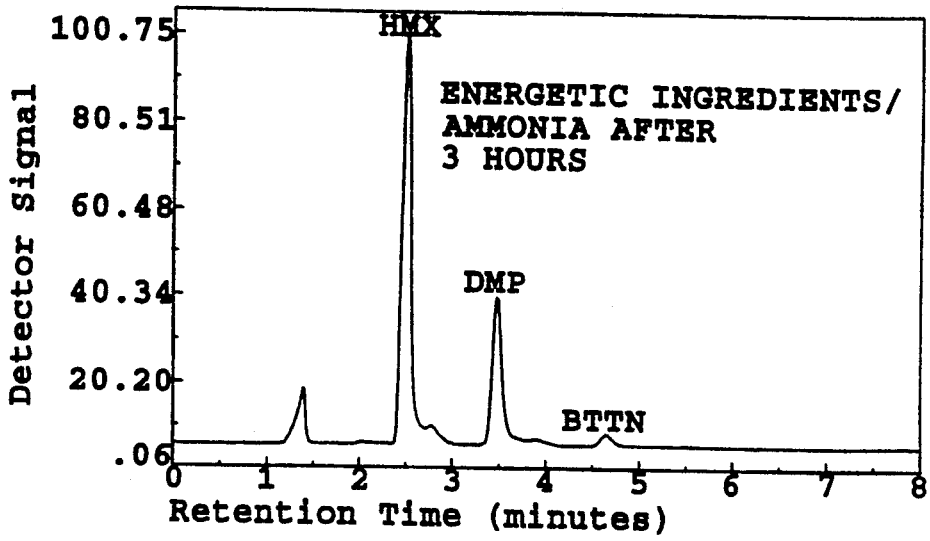
FIGS. 6*b* and 6*c* are the chromatogram results of the soluble NG, BTTN, and HMX ingredients extracted and recovered from this propellant following exposure to liquid ammonia for approximately 15 minutes and 3 hours, respectively.
Figure 6B:
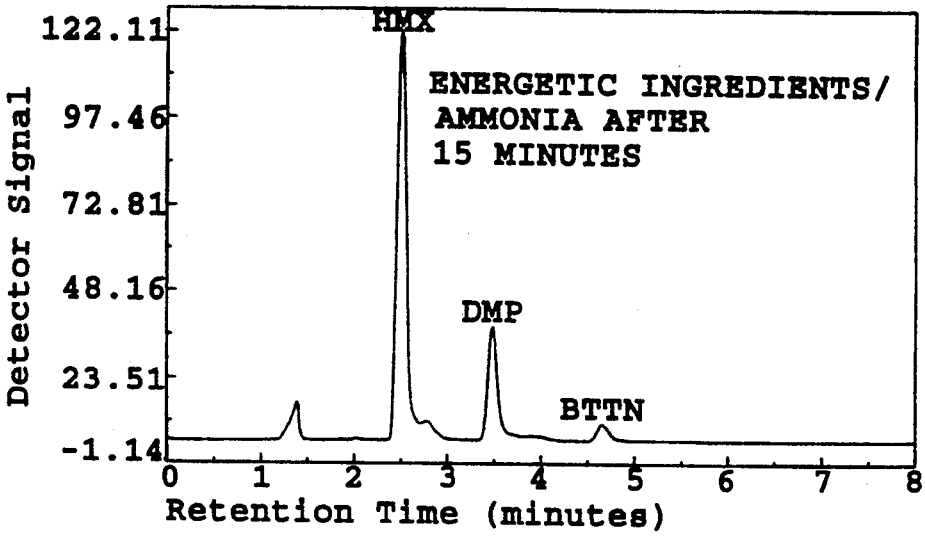
Figure 6A:
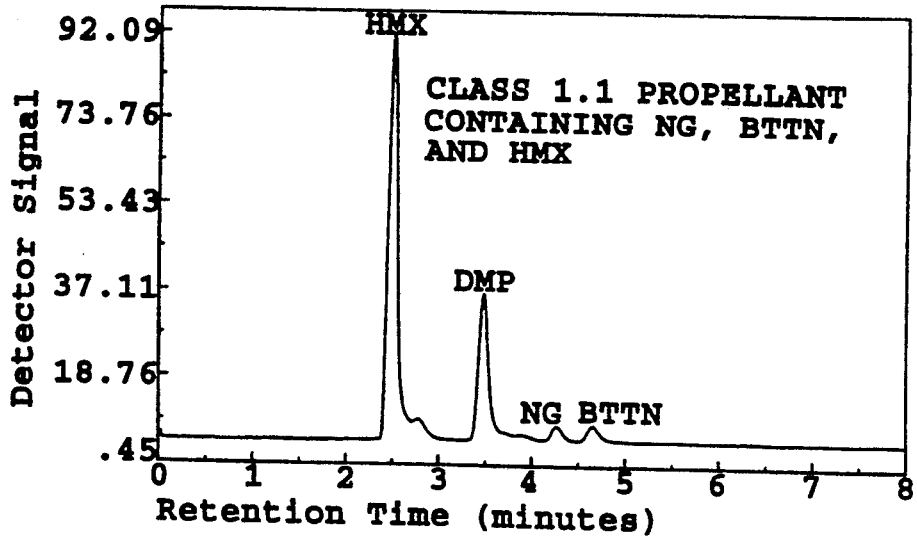
FIGS. 6*a* is a reference LC chromatogram of a mixture of NG, BTTN, AND HMX extracted from a class 1.1 minimum signature propellant that was not exposed to ammonia.

The LC analyses shown in FIGS. 5a–5d demonstrate relative degradation rates of a NG-BTTN premix lacquer at times zero, 30 minutes, 8 hours, and 24 hours, respectively. (NOTE: DMP is added as an internal standard in each chromatogram. DMP retention time is approximately 3.5 minutes). These chromatograms demonstrate that BTTN undergoes a much slower chemical degradation than NG in liquid ammonia. FIGS. 6a–6c demonstrate that the initial NG degradation process, which represents only the first of several possible decomposition steps, is completed in about 15 minutes. In contrast, BTTN experiences about 50 percent of its first decomposition step in approximately 8 hours and is completed within 24 hours. DSC analyses show the initial BTTN degradation product is energetic.

Figure 7C:
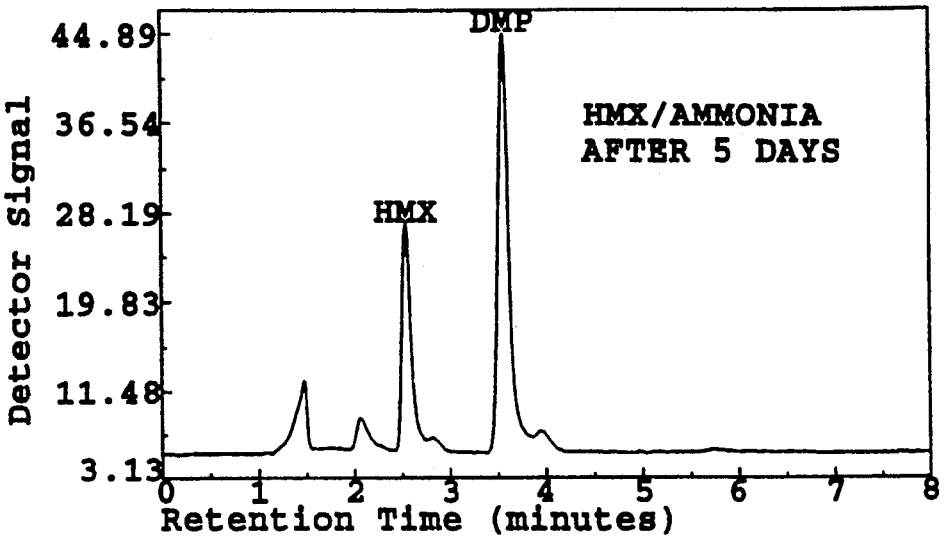
FIGS. 7*a*, 7*b*, and 7*c* are LC chromatograms that demonstrate the slow degradation of HMX in relation to RDX following their dissolution in liquid ammonia for approximately 20 minutes, 1 day, and 5 days, respectively.
Figure 7B:
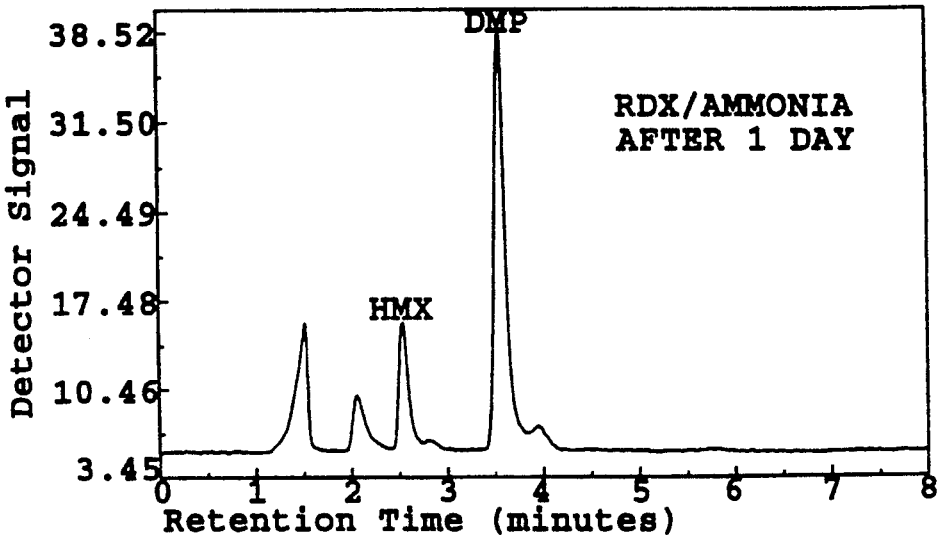
Figure 7A:
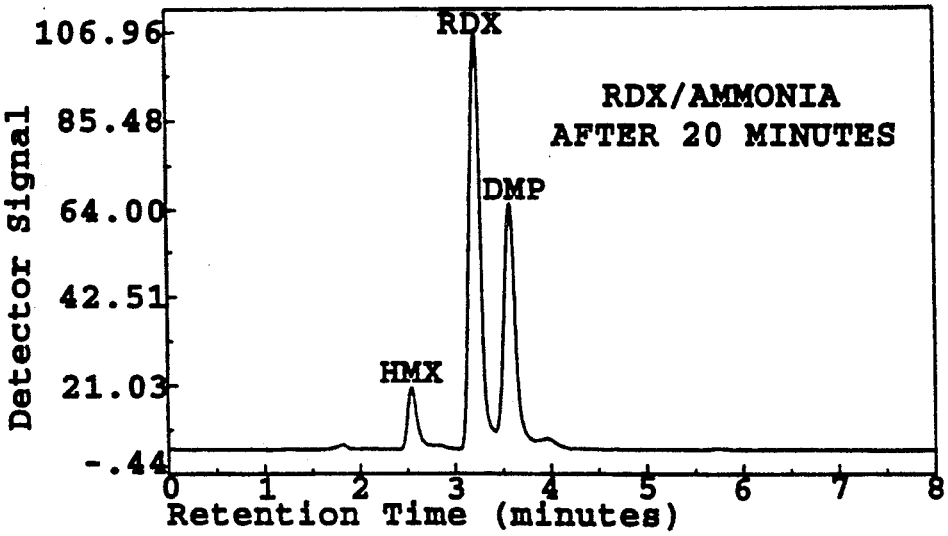

HMX is remarkably stable in liquid ammonia. The LC analyses shown in FIGS. 7a–7c demonstrate that HMX is still present after 5 days dissolution in liquid ammonia. The solubility of HMX at ambient temperatures is approximately 6 grams per 100 grams of ammonia. The solubility of RDX is approximately 10 grams per 100 grams of liquid ammonia. Because liquid ammonia is used in excess for efficient heat transfer, these solubilities are adequate for complete nitramine recovery. RDX is reasonably stable in liquid ammonia although much less so than HMX. RDX undergoes a mild degradation reaction over a 24 hour period with liquid ammonia. Although chemical degradation of RDX occurs slowly over this initial period, DSC thermograms show that the degradation products have minimal energy. RDX decomposition behavior over long durations has not been examined.

Figure 8B:
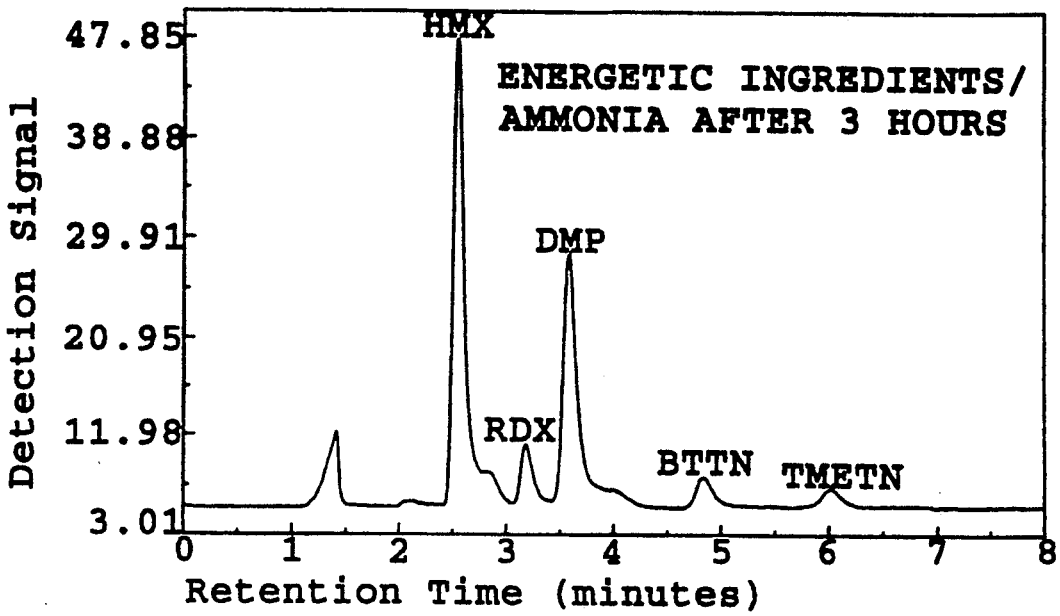
FIGS. 8*a* and 8*b* are LC chromatograms depicting the relative chemical degradation effects of BTTN, TMETN, RDX, and HMX following their dissolution in liquid ammonia for approximately 30 minutes and 3 hours, respectively.
Figure 8A:
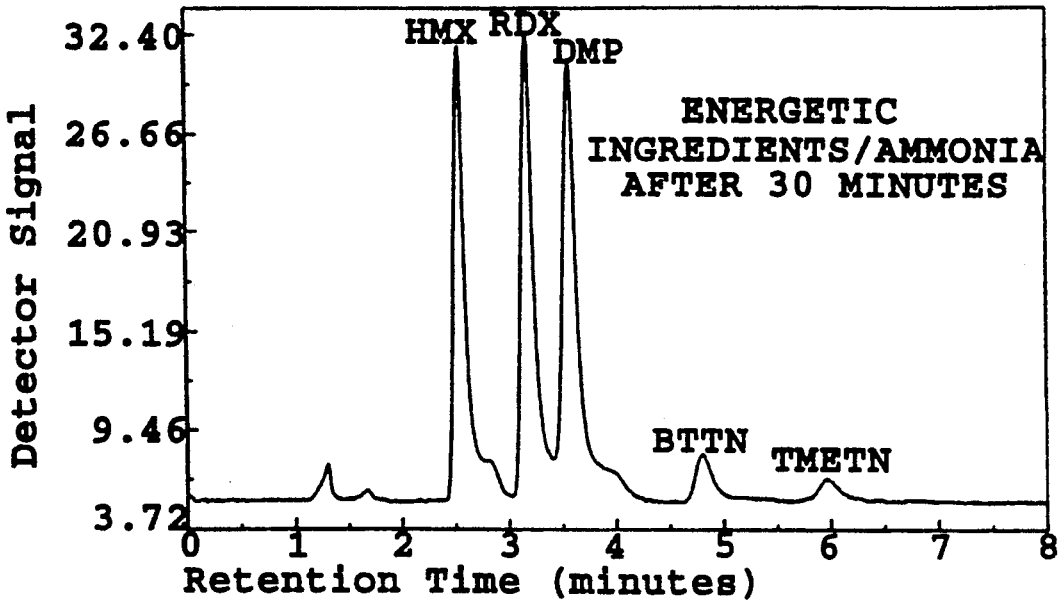

FIGS. 8a and 8b show the LC analyses of soluble BTTN, TMETN, RDX, and HMX ingredients extracted from a class 1.1 propellant using liquid ammonia. Chromatograms are shown for times 30 minutes and 3 hours. These results demonstrate that first stage degradation of RDX is appreciable after 3 hours dissolution in ammonia. Fortunately, the kinetics of this process are slow relative to the short experimental extraction and recovery times required to complete the extraction and recovery process. RDX recovered from propellant using the ammonia process has been demonstrated to be virtually identical to as-received material. Plans to reclaim the recovered HMX and RDX for potential explosives reuse are being explored. Comparisons of the chemical and physical characteristics of recovered inorganic oxidizer (AP) and organic nitramines, HMX and RDX, are provided in Tables 1 and 2 below. It is anticipated that the recovered nitratoester plasticizers can be used for co-energy generation.

TABLE 1

CHEMICAL AND PHYSICAL CHARACTERISTICS FOR AP RECOVERED USING $NH_3$ PROCESS

| | AS REC'D KERR-McGEE AP | AP/$NH_3$ RECRYSTALLIZED | AP RECOVERED PERSHING | AP RECOVERED MLRS | AP RECOVERED SHUTTLE BOOSTER |
|---|---|---|---|---|---|
| AP PURITY | 99.67% | 99.97% | 99.80% | 99.91% | 99.98% |
| CALCIUM* | 4,722 CNTS | 745 CNTS | 76 CNTS | 125 CNTS | 50 CNTS |
| IRON* | 326 CNTS | 277 CNTS | 359 CNTS | 285 CNTS | 352 CNTS |
| IR/ATR SPECTRUM | NO ORGANICS DETECTED | SAME | SAME | VERY MINOR PEAKS AT 1740 & 2900 $CM^{-1}$ POSSIBLE ORGANIC ESTER | NO ORGANICS DETECTED |
| DSC ANALYSES | PHASE CHANGE 240° C.; MINOR EXOTHERM OVER 300–320° C. | SAME | SAME | SAME | SAME |
| SPARK (ESD) | 45 JOULES | SAME | SAME | SAME | SAME |
| FRICTION | 100 LBS | SAME | SAME | SAME | SAME |
| IMPACT | 205 Kg-cm | 245 Kg-cm | 175 Kg-cm | 250 Kg-cm | 225 Kg-cm |

*A. Relative content as determined by energy dispersive X-ray fluorescence (EDXRF)
B. Calcium content is due to tricalcium phosphate anticaking agent
C. AP normally contains traces of iron as an impurity

TABLE 2

CHEMICAL AND PHYSICAL CHARACTERISTICS OF RECOVERED HMX/RDX

| | | | | |
|---|---|---|---|---|
| LC ANALYSES | 100% NITRAMINE | SAME | 100% NITRAMINE | SAME |
| DSC ANALYSES | 275 C. (ONSET) | 274 C. | 220 C. (ONSET) | 224 C. |
| IR ANALYSES | BASELINE | SAME | BASELINE | SAME |
| SPARK (ESD) | .0289 J (NEG) | SAME | .0156 J (NEG) | SAME |

TABLE 2-continued

| CHEMICAL AND PHYSICAL CHARACTERISTICS OF RECOVERED HMX/RDX | | | | |
|---|---|---|---|---|
| | .0306 (POS) | SAME | .0189 J (POS) | SAME |
| IMPACT (2 KG) | 15-20 CM | 18-20 CM | 15-20 CM | SAME |

*LC - LIQUID CHROMATOGRAPHY
**DSC - DIFFERENTIAL SCANNING CALORIMETER
***IR - INFRARED

Applicant's ammonia demilitarization process has several advantages for disposal of class 1.3 AP composite and class 1.1 nitramine-containing propellants. The major advantage of the process is that valuable ingredients, such as HMX, RDX, AP and AL, can be readily recovered for potential reuse. The rocket motor disposal process is designed to meet national environmental policy goals for resource conservation and reclamation. An important feature of the liquid ammonia method is that the ammonia solvent is recycled within a closed system with no loss to the environment. Because water or toxic organic solvents are not used in the process, the generation of additional hazardous wastes due to solvent contamination are minimized. Adverse environmental impacts typically associated with open burning, incineration, and related destruction methods are avoided. Applicant's demilitarization method provides low environmental impacts, reusable ingredients, and technology that can demonstrated using industrially available equipment.

I claim:

1. A method for extracting and recovering nitramine oxidizers from class 1.1 solid propellants using liquid ammonia solvent within a closed system provided with piping and valve means, and temperature and pressure monitoring means for said closed system for controlling demilitarization at a predetermined temperature and pressure wherein a class 1.1 solid propellant demilitarization cycle, as defined under (A) below, is employed in combination with a method for further separation and recovery of nitramine oxidizers and separation and recovery of ammonium perchlorate, when present, with degraded nitroglycerin and other plasticizers, as defined under (B) below, said class 1.1 solid propellant demilitarization cycle comprising a first, second, third, and fourth operation cycle, (A) said class 1.1 propellant demilitarization cycle comprising:

(i) completing said first operation cycle to remove said class 1.1 solid propellant contained within a pressure vessel by ablating or machining to comminute said propellant to a suitable particle size to form a slurry of said liquid ammonia solvent and said propellant, said pressure vessel having an upper section and a lower section, said first operation cycle comprising:

(a) introducing liquid ammonia solvent through high pressure nozzles with sufficient pressure to ablate said class 1.1 solid propellant contained in said pressure vessel to comminute and achieve particle size reduction to about ¼ inch or less, as required, for efficient propellant ingredient extraction;

(b) continuously forming said propellant slurry in said pressure vessel; and, (c) continuously transferring said propellant slurry to an extractor/separator vessel to achieve separation of said propellant ingredients of solubles in a liquid ammonia solvent phase and insolubles in a sediment solids portion;

(ii) completing said second operation cycle to solubilize and to extract liquid ammonia soluble class 1.1 solid propellant ingredients from said propellant slurry as a supernatant while monitoring and maintaining temperature control by venting ammonia vapor to achieve adiabatic cooling of said liquid ammonia solvent and while monitoring plasticizer degradation products employing liquid chromatography procedures and to retain liquid ammonia solvent insoluble class 1.1 solid propellant ingredients in a lower section of said pressure vessel as sediment solids, said second operation cycle comprising:

(a) removing said sediment solids comprised of binders, inert ballistic additives, and solid metal fuel ingredients from said lower section of said pressure vessel; and, (b) transferring supernatant of liquid ammonia solvent containing said extracted liquid ammonia solvent soluble class 1.1 solid propellant ingredients to an evaporator for oxidizer recovery and ammonia solvent vapor recovery;

(iii) completing said third operation cycle by evaporation of said liquid ammonia solvent containing said extracted ammonia solvent soluble class 1.1 solid propellant ingredients, said third operation cycle comprising:

(a) recovering, filtering and drying said ammonia solvent vapor for compressing to liquid ammonia for reuse in said closed system by pressure pump(s);

(b) recovering all liquid ammonia solvent soluble class 1.1 solid propellant ingredients for further separation and recovery of said nitramine oxidizers, and for further separation and recovery of ammonium perchlorate, when present, from degraded nitroglycerin and other plasticizers, said recovered propellant ingredients consisting of mixtures of nitramine oxidizers, ammonium perchlorate when present in said class 1.1 solid propellant, energetic nitratoester plasticizers and their possible chemical degradation products, and chemical stabilizers; and (iv) completing said fourth operation cycle by filtering, drying, and compression of said recovered ammonia solvent vapor for reuse, said fourth operation cycle comprising:

(a) compressing said recovered, filtered, and dried ammonia solvent vapor to liquid ammonia for solvent liquefaction and recycling; and, (b) returning liquid ammonia with high pressure and low pressure pumps to said closed system for further use in said demilitarization cycle;

(B) said method for further separation and recovery of said nitramine oxidizers and separation and recovery of ammonium perchlorate when present from degraded nitroglycerin and other plasticizers comprising:

(i) treating said liquid ammonia soluble class 1.1 solid propellant ingredients recovered, as defined under 1(A), (iii), (b), by washing with an alcohol selected from the group consisting of methanol, ethanol, and isopropanol to recover said nitramine oxidizers and impurities as insolubles and retaining solubles in solution, said solubles in solution comprising degraded nitroglycerin, other plasticizers, and ammonium perchlorate when present and if desired to be separated and retained for performing additional steps defined under (B), (iv), and (v), hereinbelow;

(ii) adding acetone/water and/or cyclohexanone/-water solution to said insolubles;

(iii) recrystallizing and recovering said nitramine oxidizers;

(iv) washing said solubles with said alcohol to achieve multiple solvating conditions for said solubles; and (v) performing an optional separating procedure when ammonium perchlorate is present and desired to be recovered from said wash solubles, said optional separating procedures selected from Soxhlet extraction employing butanol and antisolvent procedure employing an aliphatic, cyclic or aromatic hydrocarbon as an antisolvent for recovering ammonium perchlorate.

2. The method for extracting and recovering nitramine oxidizers from class 1.1 solid propellants using liquid ammonia solvent within said closed system as defined in claim 1 wherein said propellant demilitarization is performed at ambient temperature and at a pressure of about 114 psig to result in degradation of nitroglycerin in about 15 minutes and wherein a temperature increase of about 5° C. to about 10° C. resulting from reaction of nitroglycerin with liquid ammonia solvent is controllable by said venting ammonia vapor to achieve adiabatic cooling of said liquid ammonia solvent.

3. The method for extracting recovering nitramine oxidizers from class 1.1 solid propellants using liquid ammonia solvent within said closed system as defined in claim 1 wherein said liquid ammonia solvent is employed in excess of the solubility ratio of 100:6 for the nitramine oxidizer cyclotetramethylenetetranitramine, said liquid ammonia solvent excess being adequate for complete nitramine recovery and for efficient heat transfer.

* * * * *